United States Patent [19]

Johncock et al.

[11] Patent Number: 4,582,773

[45] Date of Patent: Apr. 15, 1986

[54] ELECTROPHOTOGRAPHIC PHOTORECEPTOR AND METHOD FOR THE FABRICATION THEREOF

[75] Inventors: Annette Johncock, Walled Lake; Stephen J. Hudgens, Southfield, both of Mich.

[73] Assignee: Energy Conversion Devices, Inc., Troy, Mich.

[21] Appl. No.: 729,701

[22] Filed: May 2, 1985

[51] Int. Cl.[4] ..... G03G 5/14

[52] U.S. Cl. ..... 430/65; 430/64

[58] Field of Search ..... 430/54, 66, 57, 60, 430/64, 65; 136/258

[56] References Cited

U.S. PATENT DOCUMENTS

| | | | |
|---|---|---|---|
| 4,420,546 | 12/1983 | Kanbe et al. | 430/57 |
| 4,477,549 | 10/1984 | Fujimaki et al. | 430/57 |
| 4,498,092 | 2/1985 | Yamazaki | 136/258 |
| 4,526,849 | 7/1985 | van der Voort et al. | 430/60 |

*Primary Examiner*—John L. Goodrow

*Attorney, Agent, or Firm*—Marvin S. Siskind; Ronald W. Citkowski; Lawrence G. Norris

[57] ABSTRACT

An improved electrophotographic photoreceptor includes a blocking layer formed from a doped, microcrystalline semiconductor alloy. The blocking layer is adapted to cooperate with the photoconductive layer of the photoreceptor to prevent the injection of undesirable charge carriers into the bulk of the photoconductive layer. Also disclosed are methods for the fabrication of the improved photoreceptor.

32 Claims, 2 Drawing Figures

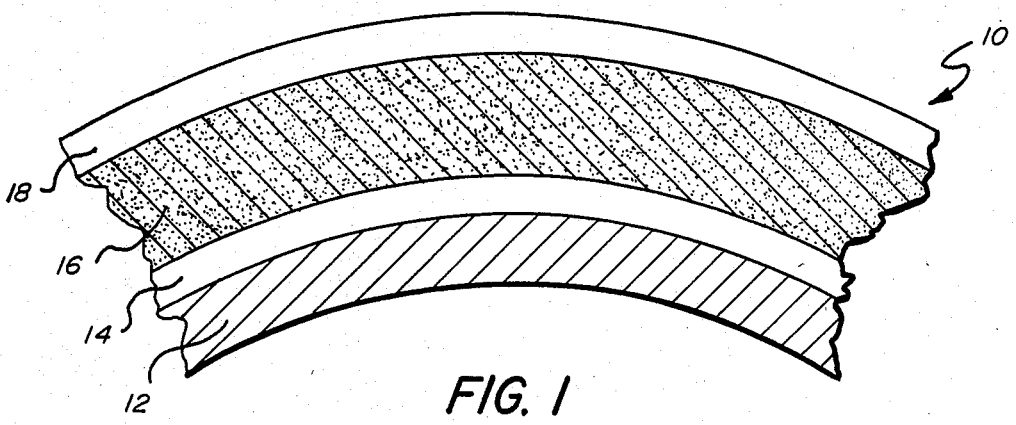
FIG. 1
FIG. 2
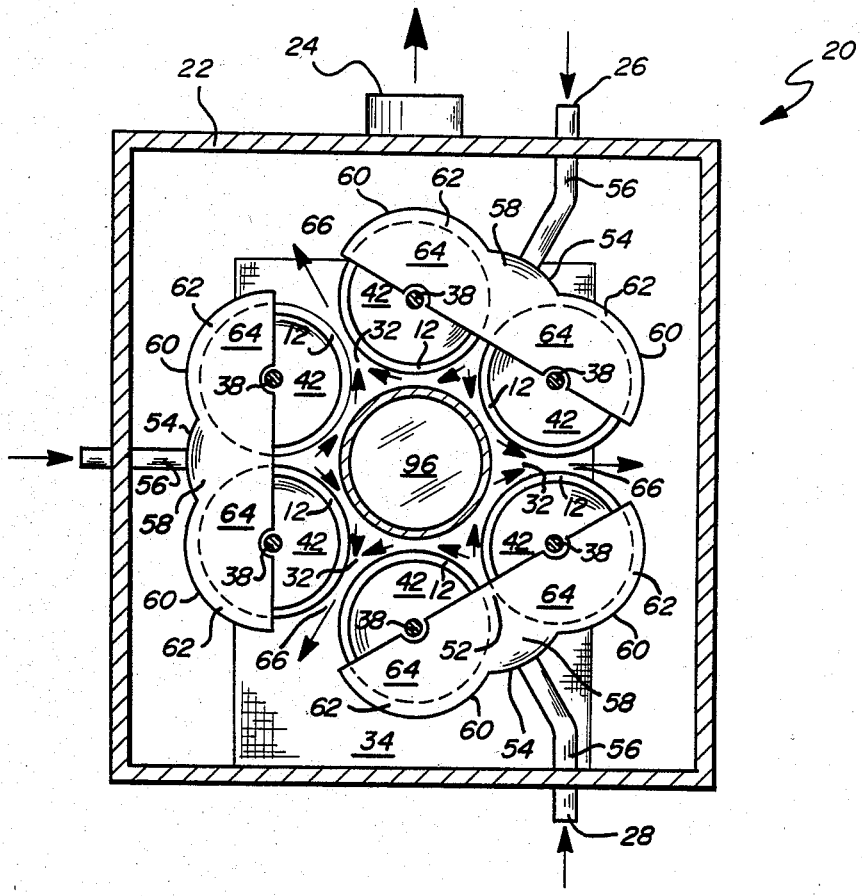

ELECTROPHOTOGRAPHIC PHOTORECEPTOR AND METHOD FOR THE FABRICATION THEREOF

FIELD OF THE INVENTION

The instant invention relates in general to electrophotography, and in particular to improved electrophotographic photoreceptors and methods for the manufacture of same.

BACKGROUND OF THE INVENTION

The instant invention relates to improved photoreceptors for use in electrophotographic imaging processes. The photoreceptors of the instant invention are characterized by (1) increased charging potential (saturation voltage, $V_{sat}$) as compared to prior art photoreceptors (2) substantially decreased loss of stored charge with the passage of time (dark decay) and (3) a decreased tendency of the component layers to crack and peel.

Electrophotography, also referred to generically as xerography, is an imaging process which relies upon the storage and discharge of an electrostatic charge by a photoconductive material for its operation. A photoconductive material is one which becomes electrically conductive in response to the absorption of illumination; i.e., light incident thereupon generates electron-hole pairs (referred to generally as "charge carriers"), within the bulk of the photoconductive material. It is these charge carriers which permit the passage of an electrical current through that material for discharge of the static electrical charge stored thereupon.

First the structure and then the operation of a typical xerographic or electrophotographic photoreceptor will be explained so that the operation and advantages of the instant invention may be fully appreciated.

As to the structure: A typical photoreceptor includes a cylindrical, electrically conductive substrate member, generally formed of a metal such as aluminum. Other substrate configurations, such as planar sheets, curved sheets or metallized flexible belts may likewise be employed. The photoreceptor also includes a photoconductive layer, which as previously described, is formed of a material having a relatively low electrical conductivity in the dark and a relatively high electrical conductivity under illumination. Disposed between the photoconductor and the substrate is a blocking layer, formed either by the oxide naturally occuring on the substrate, or from a deposited semiconductor layer. As will be discussed in greater detail hereinbelow, the blocking layer functions to prevent the flow of unwanted charge carriers from the substrate into the photoconductive layer where they could then neutralize the charge stored upon top surface of the photoreceptor. A typical photoreceptor also generally includes a top protective layer disposed upon the photocoductive layer to stabilize the electrostatic charge acceptance against changes due to adsorbed chemical species and to improve the photoreceptor durability.

In operation of the electrophotographic process: the photoreceptor must first be electrostatically charged in the dark. Charging is typically accomplished by a corona discharge or some other such conventional source of static electricity. An image of the object to be photographed, for example a typewritten page, is then projected onto the surface of the charged electrophotographic photoreceptor. Illuminated portions of the photoconductive layer, corresponding to the light areas of the projected image, become electrically conductive and pass the electrostatic charge residing thereupon through to the electrically conductive substrate thereunder which is generally maintained at ground potential. The unilluminated or weakly illuminated portions of the photoconductive layer remain electrically resistive and therefore continue to be proportionally resistive to the passage of electrical charge to the grounded substrate. Upon termination of the illumination, a latent electrostatic image remains upon the photoreceptor for a finite length of time (the dark decay time period). This latent image is formed by regions of high electrostatic charge (corresponding to dark portions of the projected image) and regions of reduced electrostatic charge (corresponding to light portions of the projected image).

In the next step of the electrophotographic process a fine powdered pigment bearing an appropriate electrostatic charge and generally referred to as a toner, is applied (as by cascading) onto the top surface of the photoreceptor where it adheres to portions thereof which carry the high electrostatic charge. In this manner a pattern is formed upon the top surface of the photoreceptor, said pattern corresponding to the projected image. In a subsequent step the toner is electrostatically attracted and thereby made to adhere to a charged receptor sheet which is typically a sheet of paper or polyester. An image formed of particles of toner material and corresponding to the projected image is thus formed upon the receptor sheet. In order to fix this image, heat and/or pressure is applied while the toner particles remain attracted to the receptor sheet. The foregoing describes a process which is the basis of many commercial systems, such as plain paper copiers and xeroradiographic systems.

It should be clear from the foregoing discussion that the electrophotograhic photoreceptor represents a very important element of the imaging apparatus. In order to obtain high resolution copies, it is desirable that the photoreceptor accept and retain a high static electrical charge in the dark; it must also provide for the flow of that charge from portions of the photoreceptor to the grounded substrate under illumination; and it must retain substantially all of the initial charge for an appropriate period of time in the non-illuminated portions without substantial decay thereof.

Image-wise discharge of the photoreceptor occurs through the photoconductive process previously described. However, unwanted discharge may occur via charge injection at the top or bottom surface and/or through bulk thermal charge carrier generation in the photoconductor material.

A major source of charge injection is at the metal substrate/semiconductor interface. The metal substrate provides a virtual sea of electrons available for injection and subsequent neutralization of, for example, the positive static charge on the surface of the photoreceptor. In the absence of any impediment, these electrons would immediately flow into the photoconductive layer; accordingly, all practical electrophotgraphic media include a bottom blocking layer disposed between the substrate and the photoconductive member. This bottom blocking layer is particularly important for electrophotographic devices which employ photoconductors with dark conductivities greater than $10^{-13}ohm^{-1}cm^{-1}$. As mentioned hereinabove, in some cases the blocking layer may be formed by native oxides occuring upon the surface of the substrate, as for example a layer of alumina occuring on aluminum. In other cases, the blocking layer is formed by chemically treating the surface of the substrate. Since it is practically important to the electrophotographic copying process to have unipolar charging characteristics, an important class of blocking layers is formed by depositing a layer of semiconductor alloy material of appropriate conductivity type onto the substrate to give rise to substantially diode-like blocking conditions.

In order to better understand the manner in which the blocking layers operate, it is necessary to review in greater depth a portion of the physics involved in the blocking layer phenomenon. As previously mentioned, the blocking layer must inhibit the transport and subsequent injection of the appropriate charge carrier (electrons for a positively charged drum) principally from the metal substrate into the body of the photoreceptor. This is accomplished in the doped semiconductor blocking layer by establishing a condition in which the minority charge carrier drift range, mu tau E, is smaller than the blocking layer thickness. Here, mu is the minority carrier mobility, tau is the minority carrier lifetime and E is the electric field strength. One can, for instance, substantially reduce the mu tau product for electrons by doping the blocking layer p-type. The excess holes present in the doped blocking layer greatly increase the probability of electron-hole recombination, thereby reducing the electron lifetime, tau. In effect one achieves a condition whereby electrons injected from the metal substrate recombine with holes in the p-type blocking layer before they are able to drift into the bulk of the photoreceptor to be swept through the top surface and neutralize the static charge thereon. However, while doping can serve to limit the mu tau product for the desired carrier, it can also give rise to deep electronic energy levels in the semiconductor alloy material. This is particularly true for semiconductors such as amorphous silicon alloys where the efficiency of substitutional doping is not high. These deep levels can become the source of thermally generated carriers or they can, if sufficiently numerous, provide a parallel path for the hopping conduction of electrons through the doped layers. Either of these phonomena can serve to compromise the blocking function of the doped layers.

Amorphous silicon alloys have great utility as photoconductors insofar as they manifest excellent bipolar photoconductivity, are durable, non-toxic and can be economically fabricated (in view of the disclosure regarding the use of microwave frequencies found in commonly assigned U.S. Pat. No. 4,504,518). However due to the short dielectric relaxation time of these photoconductors, the electrophotographic utility of amorphous silicon alloys relies heavily upon high quality blocking layers used in combination therewith.

One approach to the problem of fabricating barrier layers is disclosed in U.S. Pat. No. 4,378,417 of Maruyama, et al entitled "Electrophotographic Member With a-Si Layers." As disclosed in Maruyama, et al, a barrier layer formed of deposited oxides, sulfides or selenides may be utilized to prevent the injection of charge carriers into an amorphous silicon photoconductive layer.

Fukuda, et al in U.S. Pat. No. 4,359,512 entitled "Layered Photoconductive Member Having Barrier of Silicon and Halogen" disclose a barrier layer formed of an amorphous silicon:hydrogen:halogen alloy. A similar approach is reported in more detail in a paper entitled "Photoreceptor of a-Si:H With Diodelike Structure for Electrophotography" by Isamu Shimizu et al, published in J. Appl. Phys. 52 (4), April 1981, pp 2776–2781.

Shimizu, et al disclose doped amorphous silicon barrier layers for use in amorphous silicon photoreceptors. The data of Shimizu, et al gives a good illustration of the aforementioned need to compromise between the prevention of charge injection and the initiation of hopping conduction. FIG. 3*a* of Shimizu, et al graphically represents the change in saturation voltage (i.e. maximum charging voltage) of a photoreceptor as a function of increasing p-doping of the amorphous silicon barrier layer thereof. It will be noted from an inspection of the Figure that, with an essentially undoped blocking layer, the photoreceptor achieves a charge acceptance of approximately 35 volts per micron. As the level of doping is increased, the charge acceptance increases up to a maximum value of approximately 50 volts per micron (for a two micron laboratory sample) attained at a diborane doping level of approximately 360 ppm in the process gas. Further increases in the doping levels only serve to decrease the charge acceptance.

The initial rise in the charge acceptance results from a decrease in the mu tau product for electrons with increasing boron doping and is indicative of the increasing efficiency with which the blocking layer prevents charge injection. However the subsequent fall off in efficiency results from the onset of electron hopping conduction in the increasingly heavily doped, highly defective blocking layer. Note that the blocking layer becomes highly defective because the incorporation of the boron dopant into the host matrix of the amorphous silicon alloy material of that layer is not completely substitutional; that is to say, many of the dopant atoms do not directly substitute for silicon atoms in the amorphous matrix, but rather alloy or otherwise insert themselves in a manner which produces defect states.

Referring to FIG. 1 of Shimizu, et al it may be ascertained that at the 360 ppm doping level, the Fermi level of the resultant p-doped alloy is approximately 0.6 eV from the valence band. As is readily apparent to one skilled in the art, a higher degree of blocking would be obtained if one could employ a more heavily p-doped alloy from which to form the blocking layer. This more heavily doped blocking layer would produce an even smaller electron mu tau product and consequently provide even more effective inhibition of electron transport through the blocking layer. However, as is apparent from the data presented, Shimizu, et al were unable to employ such a more heavily doped alloy because of the inherent problem of electron hopping initiated by the doping-induced defect states. As will be noted from FIG. 3*b* thereof, the maximum charging voltage obtained by Shimizu, el al (in a photoreceptor approximating commercial utility) was slightly under 400 volts for a photoconductive layer 10 microns thick. This represents a charge acceptance of just under 40 volts per micron.

As mentioned previously, it is highly desirable to provide a blocking layer of optimized efficiency. All other properties being kept constant, a photoreceptor having an efficient blocking layer will manifest a higher saturation voltage and therefore will produce higher contrast copies than a photoreceptor having a less efficient blocking layer. Alternatively, a photoreceptor with high charge acceptance can be made thinner while still achieving the same saturation voltage thus reducing manufacturing costs through savings in fabrication time and materials costs. Additionally, a more efficient blocking layer may be made thinner, thereby decreasing stress in the deposited layers (a thinner photoreceptor is inherently less stressed), which stress can result in cracking and peeling of the layers thereof. Furthermore, the use of a highly efficent blocking layer would allow the incorporation of lower quality photoconductive material into an electrophotographic photoreceptor (a plus in production since it is easier and faster to fabricate poorer material), insofar as losses resulting from the poor quality material would be offset by gains made through the use of the more efficient blocking layer.

The instant invention provides for highly efficient blocking layers through the fabrication of those layers from highly conductive microcrystalline semiconductor alloy material. In light of the many definitions utilized for the terms "amorphous" and "microcrystalline" in the scientific and patent literature it will be helpful to clarify the definition of those terms as used herein.

The term "amorphous", as used herein, is defined to include alloys or materials exhibiting long range disorder, although said alloys or materials may exhibit short or intermediate range order or even contain crystalline inclusions. As used herein the term "microcrystalline" is defined as a unique class of said amorphous materials characterized by a volume fraction of crystalline inclusions, said volume fraction of inclusions being greater than a threshold value at which the onset of substantial changes in certain key parameters such as electrical conductivity, band gap and absorption constant occurs. It is to be noted that pursuant to the foregoing definitions, the microcrystalline, materials employed in the practice of the instant invention fall within the generic term "amorphous" as defined hereinabove.

The concept of microcrystalline materials exhibiting a threshold volume fraction of crystalline inclusions at which substantial charges in key parameters occur, can be best understood with reference to the percolation model of disordered materials. Percolation theory, as applied to microcrystalline disordered materials, analogizes properties such as the electrical conductivity manifested by microcrystalline materials, to the percolation of a fluid through a non-homogeneous, semi-permeable medium such as a gravel bed.

Microcrystalline materials are formed of a random network which includes low mobility, highly disordered regions of material surrounding randomized, highly ordered crystalline inclusions or grains having high carrier mobility. Once these crystalline inclusions attain a critical volume fraction of the network, (which critical volume will depend, inter alia, upon the size and/or shape and/or orientation of the inclusions), it becomes a statistical probability that said inclusions are sufficiently interconnected so as to provide a low resistance current path through the network. Therefore at this critical or threshold volume fraction, the material exhibits a sudden increase in conductivity. This analysis (as described in general terms relative to electrical conductivity herein) is well known to those skilled in solid state theory and may be similarly applied to describe additional physical properties of microcrystalline materials, such as optical gap, absorption constant, etc.

The onset of this critical threshold value for the substantial change in physical properties of microcrystalline materials will depend upon the size, shape and orientation of the particular crystalline inclusions, but is relatively constant for different types of materials. It should be noted that while many materials may be broadly classified as "microcrystalline" those materials will not exhibit the properties we have found advantageous for the practice of our invention unless they have a volume fraction of crystalline inclusions which exceeds the threshold value necessary for substantial change. Accordingly we have defined "microcrystalline materials" to include only those materials which have reached the threshold value. Further note that the shape of the crystalline inclusions is critical to the volume fraction necessary to reach the threshold value. There exist 1-D, 2-D and 3-D models which predict the volume fraction of inclusions necessary to reach the threshold value, these models being dependent on the shape of the crystalline inclusions. For instance, in a 1-D model (which may be analogized to the flow of charge carriers through a thin wire), the volume fraction of inclusions in the amorphous network must be 100% to reach the threshold value. In the 2-D model (which may be viewed as substantially conically shaped inclusions extending through the thickness of the amorphous network), the volume fraction of inclusions in the amorphous network must be about 45% to reach the threshold value. And finally in the 3-D model (which may be viewed as substantially spherically shaped inclusions in a sea of amorphous material), the volume fraction of inclusions need only be about 16–19% to reach the threshold value. Therefore, amorphous materials (even materials classified as microcrystalline by others in the field) may include crystalline inclusions without being microcrystalline as that term is defined herein.

Accordingly, the amorphous materials of Maruyama and Shimizu are differentiated from the microcrystalline materials of the instant invention although all may be broadly and generically termed "amorphous".

As will be described in greater detail hereinbelow, the blocking layers of the instant invention are highly efficient insofar as a high degree of substitutional doping may be readily attained therein. The greater the degree of substitutional doping, the more effectively the minority carrier mu tau product can be reduced while producing fewer defect sites which promote the hopping conduction of electrons. Furthermore, since the highly doped microcrystalline blocking layers of the instant invention are of high electrical conductivity; the large density of free charge carriers can move so as to effectively screen the electric field, E, in the blocking layer when the photoreceptor is charged. This reduced electric field produces a drift range (mu-tau-E) which is very small. Due to the microcrystalline nature of the semiconductor blocking layers of the instant invention, said layers may be doped to the point of electrical degeneracy, i.e., the Fermi level is essentially coincident with the majority carrier band edge. This has the effect of causing the activation energy for the thermal generation of unwanted minority carriers to be the maximum possible value, i.e. the semiconductor band gap energy. This is to be contrasted with prior art blocking layers, such as described in Shimizu, et al, which could not be heavily doped without providing defect sites which rendered their blocking layers practically useless through the mechanisms of thermal generation and/or hopping. Further, and as previously mentioned, the optimal doping for Shimizu, et al's blocking layer resulted in a Fermi level position about 0.6 eV away from the appropriate band edge. Therefore, the conductivity of that blocking layer remained relatively low so as to ineffectively screen the electric field, E, in the blocking layer when the photoreceptor is charged. Of course, the high electric field then produces a relatively high drift range (mu-tau-E), which high drift range allows electrons injected from the metal substrate to drift through the blocking layer and neutralize static charge on the top surface of the photoreceptor. Furthermore, since Shimizu, et al cannot lower the activation energy of their material below 0.6 Ev without compromising the efficacy of their blocking layer, their photoreceptors will exhibit a high degree of thermal charge carrier generation from the Fermi level at the blocking layer/-photoconductor interface. Since the microcrystalline materials described herein may be readily doped to degeneracy, they present as previously mentioned, the highest possible barrier (at the blocking layer/photoconductor interface) to the thermal generation of carriers from states located at the Fermi level.

By employing the principles of the instant invention, electrophotographic photoreceptors having highly efficient, highly doped blocking layers may be readily fabricated. Since the blocking layers are microcrystalline, they show less internal stress. And since the blocking layers are so efficient the overall photoreceptor thickness may be reduced, providing substantial reduction in manufacturing cost, decreased internal stress and a consequent decreased tendency towards cracking and peeling.

It is important to note that conventional scientific wisdom was diametrically opposed to experimenting with the use of highly doped microcrystalline material from which to fabricate the blocking layers for photoelectric photoreceptors. From a purely empirical point of view, the results published by Shimizu, et al taught away from increasing the doping concentration, and consequently the blocking layer conductivity, above the values obtained at approximately 350 ppm gas phase ratio of $B_2H_6$ to $SiH_4$. Further, other experience taught away from employing microcrystalline material since it was anticipated that these materials would exhibit such a high volume percentage of grain boundaries and attendent defects as to cause hopping conduction of charge carriers, thereby compromising the blocking function and providing for the neutralization of the surface charge of the photoreceptor. It was for this reason that Applicants, in commonly assigned patent application Ser. No. 580,081 filed Feb. 14, 1984, stated " . . . the bottom blocking layer does not have to be amorphous and can be, for example, polycrystalline . . . ". However, because Applicants believed the grain boundaries to be so defective as to cause hopping conduction at the Fermi level, they did not include microcrystalline material as a possible candidate from which to fabricate said bottom blocking layer.

However, it was synergistically discovered that the microcrystalline material described hereinabove was characterized by grains of sufficiently large size that the surface state defects on grain boundaries did not promote substantial hopping conduction through the blocking layer and into the bulk of the photoreceptor. For purposes of this definition microcrystalline material will be referred to as having grains under approximately 5000 Angstroms thickness and the polycrystalline material referred to in said patent application Ser. No. 580,081 has grains from approximately 5000 Angstroms to monocrystalline. Regardless of the reason for the surprising performance of the microcrystalline blocking layer, experiments have clearly demonstrated the vastly improved results in photoreceptors made possible through the use of these microcrystalline blocking layers. Specifically, saturation voltages in 20 micron thick photoreceptors which included a microcrystalline blocking layer were as high as 1296 volts with dark decay ratios (ratio of charge remaining to initial charge after three seconds of discharge) as high as 0.7. This represents a marked improvement over otherwise identically prepared 20 micron thick photoreceptors which included an optimally doped amorphous blocking layer, said latter photoreceptors characterized by saturation voltages only as high as 582 volts and dark decay ratios of 0.5.

Further, and as will be discussed in greater detail hereinbelow, the blocking layers of the instant invention may be readily fabricated from a wide variety of semiconductor materials by rapid, economical, easy to implement deposition processes.

These and other objects and advantages of the instant invention will be apparent from the detailed description of the invention, the brief description of the drawings and the claims which follow.

BRIEF SUMMARY OF THE INVENTION

There is disclosed herein an electrophotographic photoreceptor of the type including: an electrically conductive base electrode, a semiconductor layer in electrical contact with the base electrode and a photoconductive layer superposed upon and electrically communicating with the semiconductor layer. The photoconductive layer and semiconductive layer are fabricated from materials of preselected conductivity types so as to establish a blocking condition whereby injection of charge carriers of a given sign from the base electrode into the bulk of the photoconductive layer is substantially inhibited. The semiconductor layer of the instant invention is formed from a doped microcrystalline semiconductor material.

In one embodiment, the photoconductive layer of the electrophotographic photoreceptor is adapted to receive a positive electrostatic charge and the semiconductor layer is a p-doped microcrystalline semiconductor layer. In this embodiment the semiconductor layer and the photoconductive layer cooperate to block the injection of electrons from the base electrode into the bulk of the photoconductive layer. In another embodiment, the photoconductive layer of the electrophotographic photoreceptor is adapted to receive a negative electrostatic charge and the semiconductor layer is an n-doped microcrystalline semiconductor layer. In this embodiment the semiconductor layer and the photoconductive layer cooperate to prevent the injection of holes from the base electrode into the bulk of the photoconductive layer.

The photoconductive layer may be fabricated from materials chosen from the group consisting essentially of chalcogens, amorphous silicon alloys, amorphous germanium alloys, amorphous silicon-germanium alloys, photoconductive organic polymers and combinations thereof. The semiconductor layer may be fabricated from a microcrystalline semiconductor material chosen from a group consisting essentially of silicon alloys, germanium alloys, and silicon-germanium alloys. One particular material having utility in the formation of a p-doped microcrystalline alloy is a boron doped silicon:hydrogen:fluorine alloy. An alloy having utility in the fabrication of an n-doped microcrystalline semiconductor layer is a phosphorus doped silicon:hydrogen:fluorine alloy.

One particular electrophotographic photoreceptor structured in accord with the principles of the instant invention comprises an electrically conductive base electrode, which may in some instances be a drum shaped member; a doped, microcrystalline silicon:hydrogen:fluorine alloy layer disposed in electrical contact with the base electrode and a photoconductive layer of a doped or intrinsic amorphous silicon:hydrogen:fluorine alloy material generally coextensive and in electrical communication with the microcrystalline layer. The photoconductive layer is adapted to (1) receive and store an electrostatic charge and (2) discharge said stored electrostatic charge to the subjacent microcrystalline layer when illuminated. It may be preferable in some instances to include a protective layer of silicon:carbon:hydrogen:fluorine alloy material of less than one micron thickness upon the light incident surface of the photoconductive layer.

Also included within the scope of the instant invention is a method for the manufacture of an electrophotographic photoreceptor. The method includes the steps of providing an electrically conductive substrate; depositng a doped, microcrystalline semiconductor layer upon the substrate and providing a layer of photoconductive material having a first surface thereof in electrical communication with said doped microcrystalline layer. The method may include further steps of providing an additional layer of semiconductor material in electrical communication with a second surface of the photoconductive layer.

In one particular embodiment of the instant invention a glow discharge deposition process may be employed for the fabrication of at least one of the layers. The glow discharge process may include the further steps of disposing the substrate in the deposition region of an evacuable deposition chamber; providing a source of electromagnetic energy in operative communication with the deposition region; evacuating the deposition chamber to a pressure less than atmospheric; introducing a semiconductor containing process gas mixture into the deposition region and energizing the source of electromagnetic energy so as to activate the process gas mixture in the deposition region and generate activated deposition species therefrom.

In accord with one embodiment, the process gas mixture may be activated by a source of electromagnetic energy communicating with an electrode disposed in the deposition region. In another embodiment, microwave energy may be employed to activate the process gases. Microwave energy may be introduced either from an antenna or from a waveguide assembly disposed so as to direct microwave energy to the deposition region. In certain embodiments an electrical bias is imposed in the deposition region to promote ion bombardment of the substrate during the deposition process.

BRIEF DESCRIPTION OF THE DRAWINGS

FIG. 1, is a partial cross-sectional view of an electrophotographic photoreceptor of the instant invention; and, FIG. 2, is a schematic, cross-sectional view of a glow discharge deposition apparatus as adapted for the manufacture of electro-photographic photoreceptors in accord with the principles of the instant invention.

DETAILED DESCRIPTION OF THE DRAWINGS

Referring now to FIG. 1, there is illustrated in partial cross-sectional side view, a generally drum shaped electrophotographic photoreceptor 10 of the type which can be formed in accordance with the principles of the instant invention. The photoreceptor includes a generally drum or cylindrically shaped substrate 12 formed, in this embodiment, of aluminum. The deposition surface of the aluminum substrate 12 is provided with a smooth, defect free surface by well known techniques such as diamond machining and/or polishing. Disposed immediately atop the deposition surface of substrate 12 is a doped, microcrystalline semiconductor alloy layer which is adapted to serve as the bottom blocking layer 14 for the photoreceptor 10 of the instant invention. In keeping with the teachings herein, the blocking layer 14 is a highly doped, highly conductive microcrystalline semiconductor alloy layer, as will be described in greater detail hereinbelow. Disposed immediately atop the bottom blocking layer 14 is the photoconductive layer 16 of the photoreceptor 10. In accord with the principles of the instant invention, a wide variety of photoconductive materials may be employed to fabricate the photoconductive layer 16. Among some of the preferred materials are doped on intrinsic amorphous silicon alloys, amorphous germanium alloys, amorphous silicon-germanium alloys, chalcoginide materials and organic photoconductive polymers. The photoreceptor 10 also includes a top protective layer 18, which protects the upper surface of the photoconductive layer 14 from ambient conditions.

In accord with the principles of the instant invention, the blocking layer 14 is formed of a doped, microcrystalline semiconductor alloy layer. As discussed previously, a high degree of substitutional doping may be readily attained in such alloy layers without the introduction of an undue number of deleterious states therein. A wide variety of microcrystalline semiconductor materials may be employed in the practice of the instant invention. Among some of the favored alloys are silicon:hydrogen alloys, silicon:hydrogen:halogen alloys, germanium:hydrogen alloys, germanium:hydrogen:halogen alloys, silicon:germanium:hydrogen alloys, and silicon:hydrogen:halogen alloys. Among the halongenated alloys, fluorinated alloys are particularly preferred. Some such alloys having utility herein are disclosed in U.S. Pat. No. 4,217,374 of Ovshinsky et al entitled Amorphous Semiconductors Equivalent to Crystalline Semiconductors, U.S. Pat. No. 4,226,898 of Ovshinsky et al entitled Amorphous Semiconductors Equivalent to Crystalline Semiconductors Produced By A Glow Discharge Process, U.S. patent application Ser. No. 668,435 filed Nov. 5, 1984 of Yang et al entitled Boron Doped Semiconductor Materials And Method For Producing Same and U.S. patent application Ser. No. 701,320 filed Feb. 12, 1985 of Guha et al entitled Improved p-doped Semiconductor Alloy Materials And Devices Fabricated Therefrom. These patents and applications are assigned to the asignee of the instant invention and the disclosures thereof are incorporated herein by reference.

Doping of the alloys may be accomplished by any techniques and employing materials well known to those skilled in the art. Since the blocking layer 14 is made of highly conductive microcrystalline semiconductor alloy material, it may be made relatively thick without seriously impeding the operation of the photoreceptor 10 by the addition of series resistance thereto; however, it is a notable feature of the instant invention that the highly doped microcrystalline blocking layer may be made relatively thin and still provide a high degree of blocking. The only lower limit for thickness is the requirement that the drift range, the mu-tau product of the charge carrier being blocked multiplied by the average electric field strength E in the blocking layer be smaller than the thickness of the layer. It can be readily appreciated that because of the high conductivity of these blocking layers and consequently the very small distance over which an applied electric field will be reduced to zero because of dielectric screening, that this limit may be practically achieved by requiring only that the blocking layer thickness exceed the dielectric screening length.

While a wide variety of semiconductor materials may be employed to fabricate the photoconductive layer 16, it has been found that amorphous silicon, amorphous germanium and amorphous-silicon germanium alloys are particularly advantageous in the practice of the instant invention. Such alloys and methods for their preparation are disclosed in the patents and applications referred to and incorporated by reference hereinabove.

Conductivity types of the materials of the blocking layer 14 and the photoconductive layer 16 are chosen so as to establish a blocking contact therebetween whereby injection of unwanted charge carriers into the bulk of the photoconductive layer 16 is effectively inhibited. In cases where the photoreceptor 10 is adapted to be electrostatically charged with a positive charge, the bottom blocking layer 14 will preferably be fabricated from a p-doped alloy and the photoconductive layer 16 will be an intrinsic semiconductor layer, an n-doped semiconductor layer or a lightly p-doped semiconductor layer. Combinations of these conductivity types will result in the substantial inhibition of electron flow from the substrate 12 into the bulk of the photoconductor layer 16. It should be noted that intrinsic, or lightly doped semiconductor layers are generally favored for the fabrication of the photoconductive layer 16 insofar as such materials will have a lower rate of thermal charge carrier generation than will more heavily doped materials. Intrinsic semiconductor layers are most favored insofar as they have the lowest number of defect states and the best discharge characteristics.

In cases where the electrophotographic photoreceptor 10 is adapted for a negative charging, it will be desirable to prevent the flow of holes into the bulk of the photoconductive layer 16. In such instances the conductivity types of the semiconductor layers referred to hereinabove will be reversed, although obviously, intrinsic materials will still have significant utility.

The maximum electrostatic voltage which the photoreceptor 10 can sustain ($V_{sat}$) will depend upon the efficiency of the blocking layer 14 as well as the thickness of the photoconductive layer 16. For a given blocking layer efficiency, a photoreceptor 10 having a thicker photoconductive layer 16 will sustain a greater voltage. For this reason, charging capacity or charge acceptance is generally referred to in terms of volts per micron thickness of the photoconductive layer 16. For economy of fabrication and elimination of stress it is generally desirable to have the total thickness of the photoconductive layer 16 be 25 microns or less. It is also desirable to have as high a static charge maintained thereupon as possible. Accordingly, gains in barrier layer efficiency, in terms of volts per micron charging capacity, translate directly into improved overall photoreceptor preformance. It has routinely been found that photoreceptors structured in accord with the principles of the instant invention are able to sustain voltages of greater than 50 volts per micron on up to a point nearing the dielectric breakdown of the semiconductor alloy material itself.

The doped microcrystalline semiconductor layers of the instant invention may be fabricated by a wide variety of deposition techniques well known to those skilled in the art, said techniques including, by way of illustration, and not limitation, chemical vapor deposition techniques, photoassisted chemical vapor deposition techniques, sputtering, evaporation electroplating, plasma spray techniques, free radical spray techniques, and glow discharge deposition techniques.

At present, glow discharge deposition techniques have been found to have particular utility in the fabrication of the barrier layers of the instant invention. In glow discharge deposition processes, a substrate is disposed in a chamber maintained at less than atmospheric pressure. A process gas mixture including a precursor of the semiconductor material to be deposited is introduced into the chamber and energized with electromagnetic energy. The electromagnetic energy activates the precursor gas mixture to form ions and/or radicals and/or other activated species thereof which species effect the deposition of a layer of semiconductor material upon the substrate. The electromagnetic energy employed may be dc energy, or ac energy such as radio frequency or microwave energy. Such glow discharge techniques are detailed in the patent applications incorporated by reference hereinabove as well as in U.S. Pat. No. 4,504,518 of Ovshinsky et al entitled Method Of Making Amorphous Semiconductor Alloys And Devices Using Microwave Energy, which application is assigned to the assignee of the instant invention, the disclosure of which is incorporated herein by reference.

Microwave energy has been found particularly advantageous for the fabrication of electrophotographic photoreceptors insofar as it allows for the rapid, economical preparation of high quality semiconductor layers. Referring now to FIG. 2, there is illustrated a cross-sectional view of one particular apparatus 20 adapted for the microwave energized deposition of layers of semiconductor material onto a plurality of cylindrical drums or substrate members 12. It is in an apparatus of this type that the electrophotographic photoreceptor 10 of FIG. 1 may be advantageously fabricated. The apparatus 20 includes a deposition chamber 22, having a pump-out port 24 adapted for suitable connection to a vacuum pump for removing reaction products from the chamber and maintaining the interior thereof at an appropriate pressure to facilitate the deposition process. The chamber 22 further includes a plurality of reaction gas mixture input ports 26, 28 and 30 through which reaction gas mixtures are introduced into the deposition environment.

Supported within the chamber 22 are a plurality of cylindrical drums or substrate members 12. The drums 12 are arranged in close proximity, with the longitudinal axes thereof disposed substantially mutually parallel and the outer surfaces of adjacent drums being closely spaced apart so as to define an inner chamber region 32. For supporting the drums 12 in this manner, the chamber 22 includes a pair of interior upstanding walls, one of which is illustrated at 34. The walls support thereacross a plurality of stationary shafts 38. Each of the drums 12 is mounted for rotation on a respective one of the shafts 38 by a pair of disc shaped spacers 42 having outer dimensions corresponding to the inner dimension of the drums 12, to thereby make frictional engagement therewith. The spacers 42 are driven by a motor and chain drive, not shown, so as to cause rotation of the cynlindrical drums 12 during the coating process for facilitating uniform deposition of material upon the entire outer surface thereof.

As previously mentioned, the drums 12 are disposed so that the outer surfaces thereof are closely spaced apart so as to form the inner chamber 32. As can be noted in FIG. 2, the reaction gases from which the deposition plasma will be formed are introduced into the inner chamber 32 through at least one of the plurality of narrow passages 52 formed between a given pair of adjacent drums 12. Preferrably, the reaction gases are introduced into the inner chamber 32 through every other one of the narrow passages 52.

It can be noted in the figure each pair of adjacent drums 12 is provided with a gas shroud 54 connected to one of the reaction gas input ports 26, 28 and 30 by a conduit 56. Each shroud 54 defines a reaction gas reservoir 58 adjacent to the narrow passage through which the reaction gas is introduced. The shrouds 54 further include lateral extensions 60 which extend from opposite sides of the reservoir 58 and along the circumferance of the drums 12 to form narrow channel 62 between the shroud extension 60 and the outer surfaces of the drums 12.

The shrouds 54 are configured as described above so as to assure that a large percentage of the reaction gas will flow into the inner chamber 32 and maintain uniform gas flow along the entire lateral extent of the drums 12.

As can be noted in the figure, narrow passages 66 which are not utilized for reaction gas introduction into the chamber 32 are utilized for removing reaction products from the inner chamber 32. When the pump coupled to the pump out port 24 is energized, the interior of the chamber 22 and the inner chamber 32 is pumped out through the narrow passages 66. In this manner reaction products can be extracted from the chamber 22, and the interior of the inner chamber 32 can be maintained at a suitable pressure for deposition.

To facilitate the production of precursor free radicals and/or ions and/or other activated species from the process gas mixture, the apparatus further includes a microwave energy source, such as a magnetron with a waveguide assembly or an antenna disposed so as to provide microwave energy to the inner chamber 32. As depicted in FIG. 3, the apparatus 20 includes a window 96 formed of a microwave permeable material such as glass or quartz. The window 94 in addition to enclosing the inner chamber 32, allows for dispostion of the magnetron or other microwave energy source exteriorly of the chamber 22, thereby isolating it from the environment of the process gas mixture.

During the deposition process it may be desirable to maintain the drums 12 at an elevated temperature. To that end, the apparatus 20 may further include a plurality of heating elements, not shown, disposed so as to heat the drums 12. For the deposition of amorphous semiconductor alloys the drums are generally heated to a temperature between 20° and 400° and preferrably about 225° C.

It has been found advantageous, in the microwave energized deposition of microcrystalline alloy materials, to employ an external electrical bias. Biasing is accomplished by disposing an electrically charged antenna, such as a metallic wire connected to a power supply, in the plasma region. Electrical biasing, by promoting in bombardment, greatly accelerates the deposition rate of microcrystalline alloy material. It is speculated that this effect results from the increased surface mobility of depositing species produced by ion bombardment created by the bias. It has been found for example, that in an apparatus generally similar to that of FIG. 2, microcrystalline silicon alloy material deposits at a rate of approximately 20 Angstroms/second when a bias of +80 volts is employed; however, the same material deposits at only 0.8 Angstroms/second when a bias is not employed. A more detailed description of deposition apparatus of the type described herein, and as adapted for the preparation of electrophotographic photoreceptors will be found in U.S. patent application Ser. No. 580,086 filed Feb. 14, 1984 of E. Fournier et al entitled Method And Apparatus For Making Electrophotographic Devices, which patent application is assigned to the assignee of the instant invention, and the disclosure of which is incorporated herein by reference.

It should be noted that at this point the instant invention is not to be construed as being limited by the method used or apparatus used to deposit the microcrystalline semiconductor layers. The instant invention may be practiced in conjunction with any method or mode of alloy layer fabrication.

EXAMPLE 1

In this example, an electrophotographic photoreceptor was fabricated in a microwave energized glow discharge deposition system generally similar to that depicted with reference to FIG. 2. A cleaned aluminum substrate was disposed in the deposition apparatus. The chamber was evacuated and a gas mixture comprised of 0.15 SCCM (standard cubic centimeters per minute) of a 10.8% mixture of $BF_3$ in hydrogen; 75 SCCM of 1000 ppm $SiH_4$ in hydrogen and 45 SCCM of hydrogen was flowed thereinto. The pumping speed was adjusted to maintain a total pressure of approximately 100 microns in the chamber. The substrate was maintained at a temperature of approximately 300° C., and a bias of +80 volts was established by disposing a charged wire in the plasma region. Microwave energy of 2.45 GHz was introduced into the deposition region. These conditions resulted in the deposition of a layer of boron doped microcrystalline silicon:hydrogen:fluorine alloy material. The deposition rate was approximately 20 Angstroms per second and the material thus deposited had a resistance of approximately 80 ohm centimeters. Deposition of the boron doped microcrystalline p layer continued until a total thickness of approximately 7500 Angstroms was obtained.

At this point the microwave energy was terminated, and the reaction gas mixture flowing there through was changed to a mixture comprising 0.5 SCCM of a 0.18% mixture of $BF_3$ in hydrogen; 30 SCCM of $SiH_4$, 7 SCCM of $SiF_4$ and 40 SCCM of hydrogen. Pressure was maintained at 50 microns and microwave energy of 2.45 GHz introduced into the apparatus. This resulted in the deposition of a lightly p-doped (i.e. pi type) amorphous silicon:hydrogen:fluorine alloy layer. Deposition occured at a rate of approximately 100 Angstroms per second and continued until approximately 20 microns of amorphous silicon alloy was deposited at which time microwave energy was terminated.

A top protective layer of an amorphous silicon:carbon:hydrogen:fluorine alloy was subsequently deposited atop the photoconductive alloy layer. A gas mixture comprising 2 SCCM of $SiH_4$ 30 SCCM of methane and 2 of $SiF_4$SCCM was flowed into the deposition region. The microwave energy source was energized and deposition of an amorphous layer occured at a rate of approximately 40 Angstroms per second. Deposition continued until approximately 5000 Angstroms of the alloy layer was deposited at which time the microwave energy was terminated, the apparatus was raised to atmospheric pressure and the thus prepared photoreceptor removed for testing.

Samples of the microcrystalline, p-doped silicon alloys prepared according to the foregoing were subjected to examination by transmission electron microscopy. It was found that they were comprised of approximately 80% microcrystallites. The microcrystalline grains were approximately 50 to 150 Angstroms in diameter, with 1 to 2% inclusions of grains of approximately 250 Angstroms diameter. It was also noted that the grains tended to aggregate into clusters of approximately 2000 Angstroms in diameter. Further, microscopy revealed that the microcrystalline layer includes a more disordered, substantially amorphous transition region proximate the substrate/microcrystalline layer interface. While it has not been ascertained whether this transition region aids in preventing the injection of charge carriers, for purposes of discussion herein, the transition region (when it occurs) shall also be termed part of the microcrystalline layer. Additional analyses were made by Raman Spectroscopy. It was found that the amorphous silicon photoconductive layer was sufficiently transparent to laser irradiation of approximately 800 nm to enable analyses of the microcrystalline layer to be carried out on intact photoreceptors. Finally, it is noteworthy that samples exhibiting these structural features show evidence of high substitutional doping efficiency, and are characterized by electrical conductivity of up to approximately 200 inverse ohm-centimeters.

The electrophotographic photoreceptor was subjected to charging tests and it was found that it could sustain a saturation voltage of approximately 1400 volts. When installed in an electrophotographic copying machine, clear copies having good resolution were obtained.

It should be understood that numerous modifications and variations should be made to the foregoing within the scope of the instant invention. While the foregoing examples were primarily the oriented toward electrophotographic photoreceptors formed of amorphous silicon alloy materials, the instant invention is obviously not so limited but may be utilized in conjunction with the fabrication of photoreceptors which include a wide variety of photoconductive material such as chalcogenide photoconductive materials as well as organic photoconductive materials. The barrier layers of the instant invention may be fabricated from a wide variety of microcrystalline semiconductor alloy materials in keeping with the spirit of the instant invention. Furthermore, the barrier layers of the instant invention need not be restricted for use solely with electrophotographic photoreceptors but may be similarly employed whenever a high quality unipolar blocking contact is to be established to a semiconductor layer. Accordingly, the principles of the instant invention will also have utility in the general field of semiconductor devices, such devices including non-electro photographic photoconductive sensors, diodes, memory arrays, display devices high voltage optically acitivated switches, vidicons, and the like.

The preceeding drawings, description, discussion and examples are merely meant to be illustrative of the instant invention and are not meant to be limitations upon the practice thereof. It is the following claims, including all equivalents, which define the instant invention.

What we claim is:

1. An electrophotographic photoreceptor of the type including: an electrically conductive base electrode, a semiconductor layer in electrical contact with said base electrode and a photoconductive layer having a first surface thereof electrically communicating with said semiconductor layer and in superposed relationship therewith; said semiconductor layer and said photoconductive layer being fabricated from materials of preselected conductivity types so as to establish a blocking condition whereby injection of charge carriers of a given sign from the base electrode into the bulk of the photoconductive layer is substantially inhibited, said semiconductor layer being formed of a doped microcrystalline semiconductor material and having a thickness greater than the drift range of minority carriers in said doped microcrystalline semiconductor material.

2. An electrophotographic photoreceptor as in claim 1, wherein said photoconductive layer is adapted to receive a positive electrostatic charge and said semiconductor layer is a p-doped microcrystalline semiconductor layer, said semiconductor layer and said photoconductive layer cooperating to block the injection of electrons from the base electrode into the bulk of the photoconductive layer.

3. An electrophotographic photoreceptor as in claim 1, wherein said base electrode is a cylindrically shaped member.

4. An electrophotographic photoreceptor as in claim 1, wherein said photoconductive layer is adapted to receive a negative electrostatic charge and said semiconductor layer is an n-doped microcrystalline semiconductor layer, said semiconductor layer and said photoconductive layer cooperating to prevent the injection of holes from the base electrode into the bulk of the photoconductive layer.

5. An electrophotographic photoreceptor as in claim 1, wherein said photoconductive layer is fabricated from a material chosen from the group consisting essentially of: chalcogens, amorphous silicon alloys, amorphous germanium alloys, amorphous silicon-germanium alloys, photoconductive organic polymers and combinations thereof.

6. An electrophotographic photoreceptor as in claim 1, wherein said semiconductor layer is fabricated from a microcrystalline semiconductor material chosen from the group consisting essentially of: silicon alloys, germanium alloys, and silicon-germanium alloys.

7. An electrophotographic photoreceptor as in claim 1, wherein said semiconductor layer is formed from a p-doped microcrystalline silicon alloy material and said photoconductive layer is formed from an amorphous silicon alloy material chosen from the group consisting essentially of: doped alloy materials, lightly doped alloy materials and intrinsic alloy materials.

8. An electrophotographic photoreceptor as in claim 1, wherein said semiconductor layer is formed from an n-doped microcrystalline silicon alloy material and said photoconductive layer is formed from an amorphous silicon alloy material chosen from the group consisting essentially of: doped alloy materials, lightly doped alloy materials and intrinsic alloy materials.

9. An electrophotographic photoreceptor as in claim 10, wherein said p-doped microcrystalline alloy is a boron doped silicon:hydrogen:fluorine alloy.

10. An electrophotographic photoreceptor as in claim 11, wherein said n-doped microcrystalline semiconductor alloy is a phosphorus doped silicon:hydrogen:fluorine alloy.

11. An electrophotographic photoreceptor as in claim 1, wherein said doped microcrystalline semiconductor material has a volume fraction of crystalline inclusions within the range of 30 to 100%.

12. An electrophotographic photoreceptor as in claim 1, wherein the conductivity of said doped microcrystalline semiconductor material is in the range of 1 to $10^3$ $ohm^{-1}cm^{-1}$.

13. An electrophotographic photoreceptor as in claim 1, wherein said doped microcrystalline semiconductor material is substantially electrically degenerate.

14. An electrophotographic photoreceptor as in claim 1, wherein the thickness of said semiconductor layer is less than 1 micron.

15. An electrophotographic photoreceptor comprising:

an electrically conductive base electrode member;

a doped, microcrystalline silicon: hydrogen:fluorine alloy layer disposed in electrical contact with said base electrode member, said microcrystalline layer having a thickness greater than the drift range of minority carriers therein; and, a photoconductive layer of an amorphous silicon:hydrogen:fluorine alloy material generally coextensive and in electrical communication with the microcrystalline layer, said amorphous layer adapted to (1) receive and store an electrostatic charge and (2) discharge said stored electrostatic charge to the subjacent microcrystalline layer when illuminated.

16. An electrophotographic photoreceptor as in claim 15, further including a layer of a silicon:hydrogen:fluorine alloy material of less than 1 micron thickness disposed upon the light incident surface of the photoconductive layer.

17. An electrophotographic photoreceptor as in claim 15, wherein said photoconductive layer is less than 30 microns thick, and said photoreceptor is capable of receiving and storing an electrostatic charge of at least 1800 volts.

18. A method of manufacturing an electrophotographic photoreceptor including the steps of:

providing an electrically conductive substrate member;

depositing a doped, microcrystalline semiconductor layer upon the substrate member, said doped microcrystalline layer having a thickness greater than the drift range of minority carriers therein; and, providing a layer of photoconductive material having a first surface thereof in electrical communication with said doped microcrystalline layer.

19. A method as in claim 18, including the further step of;

providing a layer of semiconductor material in electrical communciation with a second surface of said photoconductive layer.

20. A method as in claim 18, including the further step of;

employing a glow discharge deposition process for the fabrication of at least one of said layers.

21. A method as in claim 20, wherein the step of employing a glow discharge deposition process includes the further steps of;

disposing the substrate member in the deposition region of an evacuable deposition chamber;

providing a source of electromagnetic energy in operative communication with the deposition region;

evacuating the deposition chamber to a pressure less than atmospheric;

introducing a semiconductor containing process gas mixture into the deposition region; and, energizing the source of electromagnetic energy so as to activate the process gas mixture in the deposition region and generate activated deposition species therefrom.

22. A method as in claim 21, wherein the step of providing a source of electromagnetic energy includes disposing an electrode in the deposition region; and, the step of energizing the source of electromagnetic energy includes the step of providing radio frequency energy to the electrode.

23. A method as in claim 21, wherein the step of providing a source of electromagnetic energy includes the step of providing a source of microwave energy.

24. A method as in claim 23, wherein the step of providing a source of microwave energy comprises providing a source of 2.45 GHz microwave energy.

25. A method as in claim 23, wherein the step of providing a source of microwave energy includes operatively disposing at least one microwave energized magnetron so as to direct microwave energy to the deposition region.

26. A method as in claim 24, wherein the step of providing a source of microwave energy includes operatively disposing at least one microwave energized antenna so as to direct microwave energy to the deposition region.

27. A method as in claim 23, further including the step of providing a source of electrical bias in the deposition region.

28. A method as in claim 27, wherein the step of providing a source of electrical bias comprises providing an electrically charged wire in the deposition region.

29. A method as in claim 28, wherein said wire is maintained at a potential of +50 to +100 volts.

30. A method as in claim 18, wherein the step of depositing a doped, microcrystalline semiconductor alloy layer comprises depositing a p-doped silicon:hydrogen:fluorine alloy layer.

31. A method as in claim 18, wherein the step of depositing a doped, microcrystalline semiconductor alloy layer comprises depositing a n-doped silicon:hydrogen:fluorine alloy layer.

32. A method as in claim 18, wherein the step of providing a layer of photoconductive material includes selecting said material from the group consisting essentially of: amorphous silicon alloys, amorphous germanium alloys, amorphous silicon-germanium alloys, photoconductive organic polymers and combinations thereof.

* * * * *

UNITED STATES PATENT AND TRADEMARK OFFICE

CERTIFICATE OF CORRECTION

PATENT NO. : 4,582,773

DATED : April 15, 1986

INVENTOR(S) : Annette Johncock, Walled Lake; Stephen J. Hudgens, Southfield, both of Michigan It is certified that error appears in the above-identified patent and that said Letters Patent are hereby corrected as shown below:

Column 17, line 47, insert --carbon:-- after "silicon:".

Signed and Sealed this

Tenth Day of February, 1987

*Attest:*

DONALD J. QUIGG

*Attesting Officer*

*Commissioner of Patents and Trademarks*